United States Patent [19]

Strong

[11] 4,448,536

[45] May 15, 1984

[54] CONCRETE MIXER DEVICE

[76] Inventor: William A. Strong, Rte. 11, Box 1150, Brinkley Rd., Pine Bluff, Ark. 71611

[21] Appl. No.: 406,173

[22] Filed: Aug. 9, 1982

[51] Int. Cl.[3] ..... B28C 5/14

[52] U.S. Cl. ..... 366/66; 366/67; 366/193; 366/300; 366/310

[58] Field of Search ..... 366/15, 66, 67, 192, 366/193, 297, 310, 300, 320; 222/505, 506

[56] References Cited

U.S. PATENT DOCUMENTS

| | | | |
|---|---|---|---|
| 1,001,508 | 8/1911 | Craig | 366/320 X |
| 1,422,102 | 7/1922 | Hutchinson | 366/320 X |
| 2,662,671 | 12/1953 | Almas | 222/505 |
| 2,772,818 | 12/1956 | McLauchlan | 366/320 X |
| 3,138,167 | 6/1964 | Fisher | 366/320 X |
| 3,188,509 | 6/1965 | Strong | 366/66 |

*Primary Examiner*—Philip R. Coe
*Attorney, Agent, or Firm*—Stephen D. Carver

[57] ABSTRACT

A mixing device for preparing wet mix cementitious products comprised of large aggregates includes a pair of generally tubular, horizontally disposed casings which form a mixing chamber, and which share common, open sides. An open top of the chamber receives raw materials to be mixed. Elongated central impeller shafts extend longitudinally, generally coaxially within each of the casings, rotatably terminating in appropriate bearings. A pump impeller assembly removably mounted to each of the impeller shafts includes rigid, spaced-apart spiders having three, integral, radially spaced-apart outwardly extending arm segments. The spider arm segments support a pair of spiralled, spaced-apart mixing rods. A similarly spiralled, outermost resilient wiping blade extends between the outermost portions of the spider segments in spaced relation with respect to the mixing rods and contacts the inner surfaces of the chamber casings in response to rotation whereby aggregates are thoroughly blded to form a uniformly mixed cementitious product.

2 Claims, 11 Drawing Figures

FIG. 1
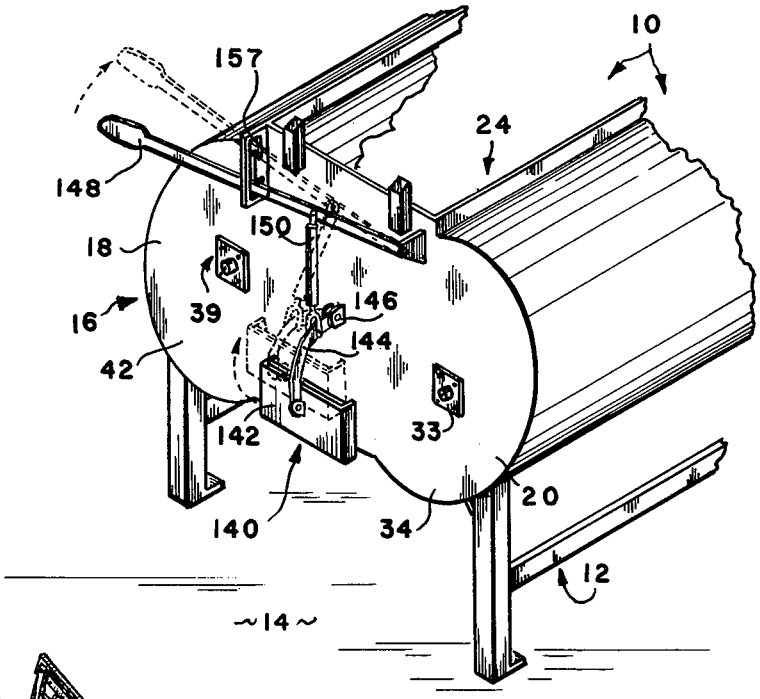
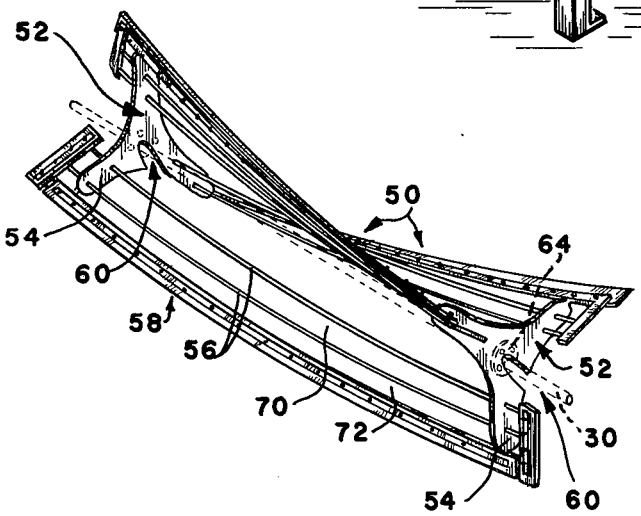
FIG. 2
FIG. 3
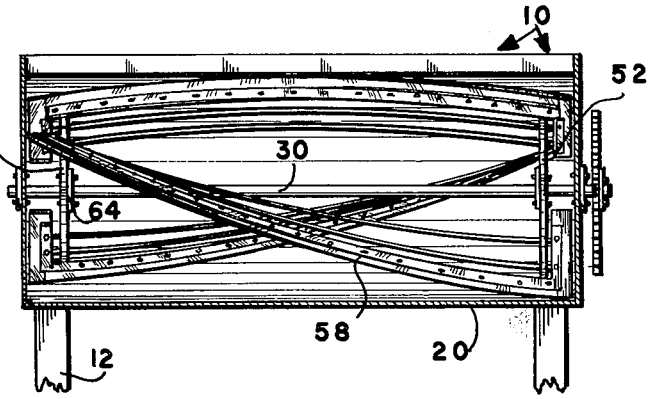

FIG. 7
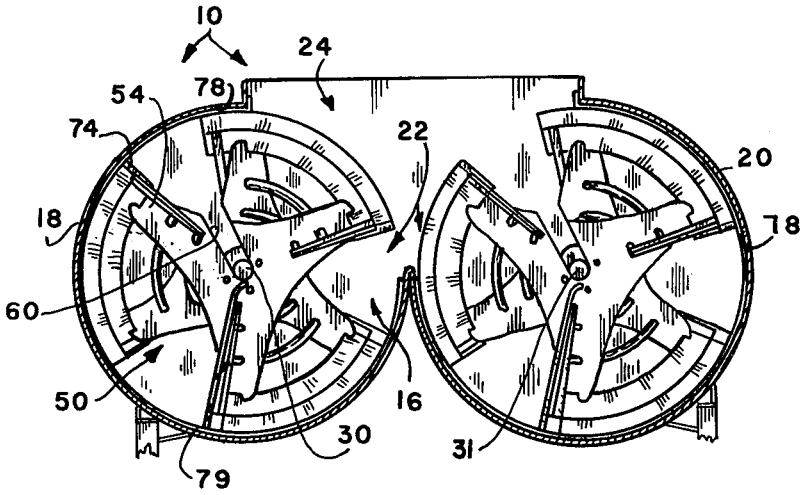
FIG. 8
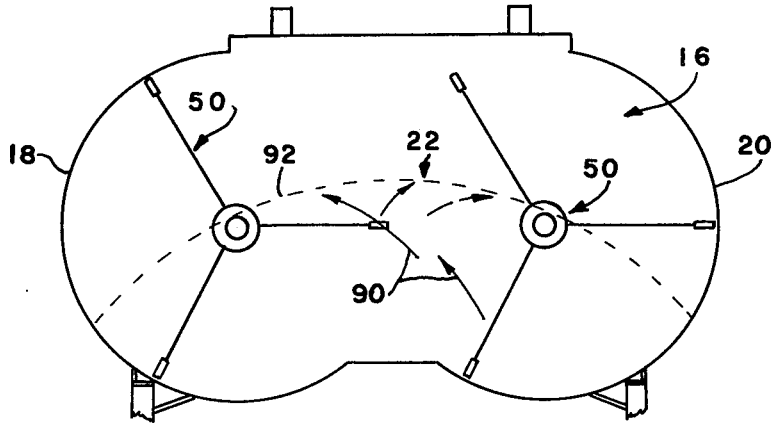
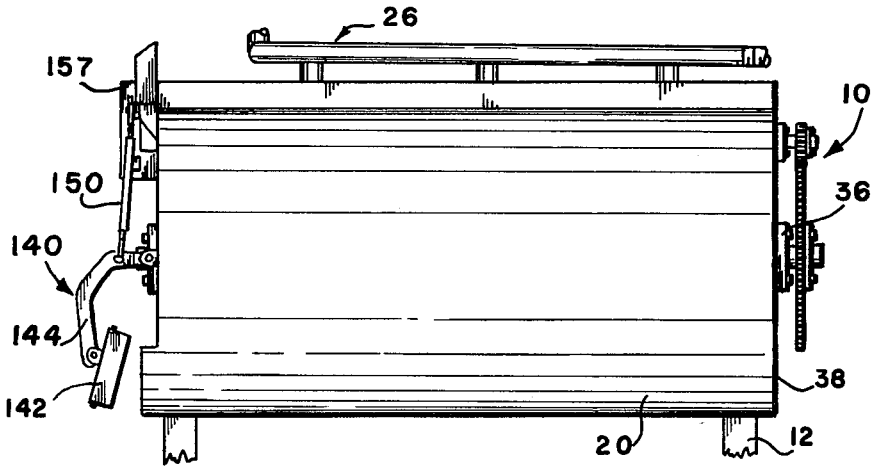
FIG. 9

CONCRETE MIXER DEVICE

BACKGROUND OF THE INVENTION

This invention relates generally to wet mix concrete mixing machines. More particularly, the present invention is concerned with wet mix machines adapted to process relatively large aggregates.

In my prior patent, U.S. Pat. No. 3,188,059, issued June 8, 1965, I devised a system for producing wet mix concrete in which a pair of rotatable, generally horizontally oriented impeller assemblies are mounted for rotation within a mixing chamber. The chamber is formed from a pair of generally tubular, horizontally disposed pump casings, which share a common, open internal side. The impeller assembly includes spirally formed blades which extend along the outer periphery of the impeller spiders. The blades wipingly contact the inner surfaces of the casings to produce blending of aggregates and materials within the chamber.

A variety of aggregates may be used to prepare a desired cementitious product. These aggregates and/or other materials are generally mixed with water, and a foam may be inputted to trap air in small dispersed pockets generally uniformly throughout the mixture. The foam for the mix may be developed by injecting a liquid detergent, water and air, all under pressure, through conventional nozzles into the mix of aggregates of cement. Typical materials for preparing such mixtures may comprise sand, gravel, and expanded vermiculite, mica or perlite. However, where gravel, or other relatively large aggregates are to be mixed within the cementitious product, problems have heretofore been experienced with the efficiency of my prior design. While the impeller assembly of my previous design accomplishes uniform mixture of generally light weight cementitious materials, becasue of the impeller design, processing of large aggregate materials is impeded since the fine screen mesh in the wiper blade is of insufficient diameter to provide clearance for aggregate particles.

However, as indicated in the specification of the previously mentioned patent, the particular configuration of a pair of horizontally disposed generally spirally formed impeller assemblies, which rotate in opposite directions, adds particular advantages insofar as providing a uniform mix. One of the reasons for the latter phenomena is that as rotation continues, the cementitious materials are uniformly mixed simultaneously with the natural conveyance of the blend towards the discharge of the unit. Increased drag and frictional losses experienced with larger aggregates in my earlier design may interfere with the natural passage of the mixed material toward the discharge orifice. Moreover, when motor power and/or speed are increased to handle large aggregate materials, the mechanical wear and tear on moving parts increases radically, resulting in down time and required repairs. Also, the expense of providing larger motors to handle the increased drag and resistance of larger aggregate materials is prohibitive.

Another problem with my prior art design relates to the handling of the door structure when discharging materials containing large aggregate. The previous sliding type design has been found insufficient since large diameter aggregate particles tend to jam the door and prevent its efficient operation. On the other hand, it is nevertheless required to provide easily operable mechanical means for manually moving the door between unobstructed open positions and reliably sealed positions.

SUMMARY OF THE INVENTION

This invention comprises a concrete mixing device in which a pair of impeller assemblies are mounted side by side for cooperative, simultaneous mixing of cementitious materials characterized by large aggregate constituents.

For these purposes a mixing chamber is formed from a pair of generally tubular, horizontally disposed pump casings secured above a supporting surface by a suitable rigid frame. An impeller assembly is rotatably disposed generally longitudinally within each of the casings. An upper, open top of the mixing device allows the direct input of materials to be mixed. Each of the impeller assemblies will thoroughly agitate and blend the material, and during rotation, will force the material towards a front discharge opening provided in the chamber.

Each impeller assembly is removably coupled to a central impeller shaft, which generally coaxially extends throughout each casing, terminating in suitable bearings. The impeller assembly includes a plurality of rigid, spaced-apart outwardly extending arm segments and a central, inner notch adapted to clear the impeller shaft for mounting. A plurality of pairs of spiralled, spaced-apart mixing rods extend between opposite arm segments of the spiders. A similarly spiralled, outermost wiping blade extending between the outermost portions of the spider arm segments wipingly contacts the interior surface of the chamber casing. However, when larger aggregate materials are contacted, said aggregates are moved over the wiping portions and are discharged between the mixing rod pairs. Because of the spiral construction of the impeller assemblies, the contra rotation thereof will blend the product constituents while simultaneously conveying the product towards a central, front mounted discharge orifice.

The discharge orifice is blocked or unblocked by a door assembly which can be manually locked in either opened or closed positions. The assembly includes a generally planar door blade which is forced into engagement or disengagement with the discharge opening by a generally arcuate link pivotally coupled to the plate. The opposite end of the link is pivotally secured to the mixor, and an elongated rigid handle coupled to the link thus forces the door inwardly or outwardly with respect to the discharge orifice to effectuate opening and closing.

The unique spider mounting assembly is easily removed for maintenance. Moreover, where different aggregate blends are to be prepared by the customer, the impeller assemblies may be readily changed if desired.

Thus a broad object of the present invention is to provide an improved mixor machine ideally adapted for large aggregate constituents of cementitious materials.

Another object of the present invention is to increase the efficiency of a mixing machine for cementitious materials.

Another object is to increase the longevity of the mechanical parts employed within mixing machines.

A similar object is to provide a removable impeller assembly for mixing machines which may be easily and quickly changed or repaired in the field.

A further object of the present invention is to provide an impeller assembly for mixing machines of the character described which will adequately and uniformly blend large aggregate materials, such as gravel or the like, to provide a consistent mixture.

A still further object of the present invention is to provide a mixing device of the character described with a reliable door system which will resist jamming, leaking or the like, notwithstanding the inclusion of large aggregate constituents within the blend.

A more basic object is to provide an improved impeller assembly for a cementitious product mixing device.

Yet another object is to provide an abrasion resistant mixing chamber ideally adapted for large aggregate blends.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 1 is a fragmentary, isometric view of a mixing device constructed in accordance with the teachings of this invention, with portions thereof shown in section or omitted for brevity, and with moved positions illustrated in dashed lines;

FIG. 2 is an isometric view of an impeller assembly constructed in accordance with the teachings of this invention;

FIG. 3 is a side sectional view of the mixing device;

FIG. 7 is a sectional view of the mixing device taken generally along line 7—7 of FIG. 6 and illustrating the configuration of the cooperating impeller assemblies;

FIG. 8 is a diagrammatic view illustrating basic material flow;

FIG. 9 is a side elevational view of the mixing device;

DETAILED DESCRIPTION OF THE DRAWINGS

Figure 4:
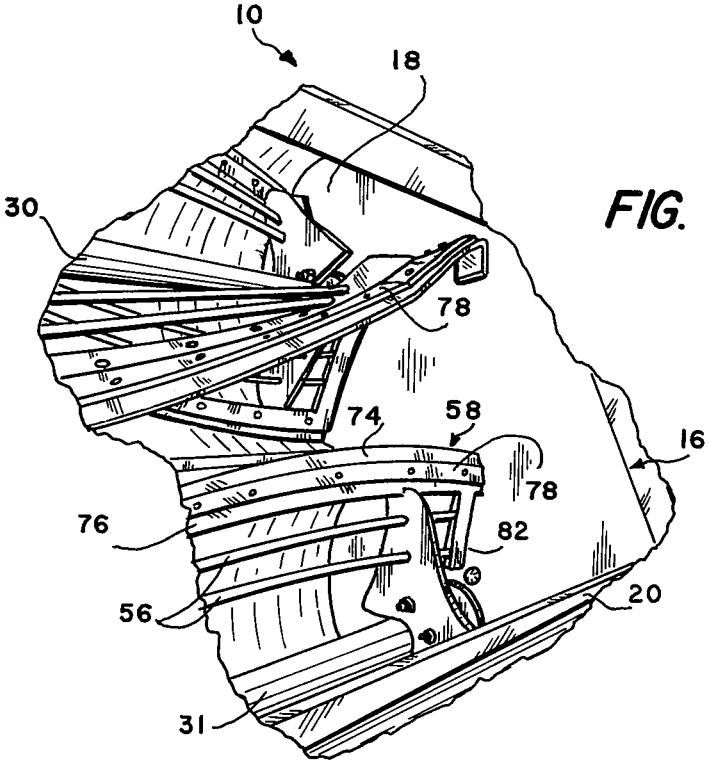
FIG. 4 is an oblique view of the rear interior of the mixing device, with portions therof broken away or shown in section for clarity.

With reference now to the accompanying drawings, a mixing device constructed in accordance with the teachings of the present invention has been generally designated by the reference numeral 10. The mixer 10 includes a rigid, generally upright frame 12 formed of rigid angle iron or the like which supports the apparatus above a solid supporting surface such as floor 14. Mixer 10 includes a mixing chamber, generally designated by the reference numeral 16, comprised of a pair of generally tubular, horizontally disposed pump casings 18 and 20. As best illustrated in FIG. 7, these pump casings share a common, open inner side generally designated by the reference numeral 22. Cementitious aggregates and the like may be dumped into chamber 16 through an open top, generally designated by the reference numeral 24. Additionally, a water injection system, generally designated by the reference numeral 26 (FIG. 11) injects water internally of the chamber to mix the desired blend.

Casings 18 and 20 receive internal, coaxially disposed elongated impeller shafts 30, 31 respectively, which extend coaxially through the casings and which are journalled for rotation in opposite casing ends. For example, shaft 31 terminates in a bearing assembly 33 provided in the front end 34 of casing 20, and terminates at the rear end thereof in a suitable bearing assembly or pillow block 36 secured centrally at the rear 38. Shaft 30 extends between a bearing assembly 39 provided in the front end 42 of casing 18 and terminates in a suitable bearing, generally designated by the reference numeral 46 provided at the casing rear end 47. Each of the casings houses an elongated impeller assembly generally designated by the reference numeral 50 (FIG. 2).

As best viewed in FIGS. 2, 3 and 7, each impeller assembly comprises a pair of spaced apart, rigid spiders 52 which are secured to the impeller shafts 30 or 31. Each spider 52 preferably includes three equally radially spaced apart arm segments 54 which secure a pair of spiralled, generally cylindrical mixing rods 56 which extend between arm segments of opposite spiders. Also, the spider arms support an outermost, similarly spiralled resilient wiping blade assembly generally designated by the reference numeral 58. As best viewed in FIG. 2, generally centrally defined notches 60 are formed within the spiders 52 to provide clearance for shafts 30, 31. A plurality of mounting holes are defined centrally of the spiders 52 to receive appropriate mounting hubs 64 which are keyed to shaft 30 or 31 to secure spiders 52. Removal of the conventional mounting bolts which secure hubs 64 to spiders 52 will permit the operator of the device to lift out impeller assembly 50 by suitably maneuvering it out from the mixing chamber.

Figure 5:
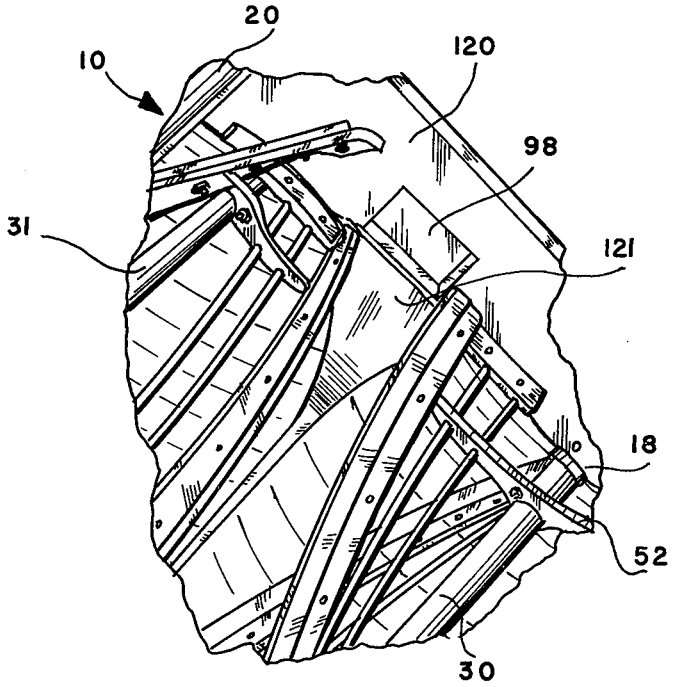
FIG. 5 is an oblique view of the front interior of the mixing device, with portions thereof broken away or shown in section for clarity.
Figure 6:
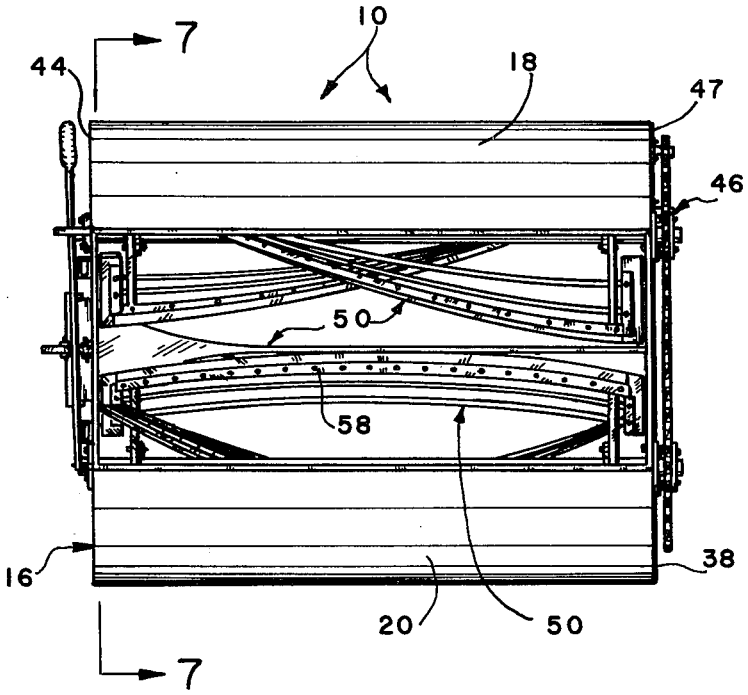
FIG. 6 is a top plan view of the mixing device of FIG. 1.

Each of the mixing rods 56 are spiralled towards opposing arm segments of the spiders, as best illustrated in FIGS. 3 through 5. It will be noted that a space 70 is defined between adjacent mixing rods 56, and that a similar space 72 is defined between the outermost mixing rod and the wiping assembly 58. The wiping assembly or 58 includes a resilient rubber or plastic wiper portion 74 secured in place about a rigid portion 76 of the assembly by metallic mounting strips 78. As best viewed in FIG. 7, the outermost portions of the wiping blade 74 will thus contact the inner linings 79 of each mixing casing. The extreme ends above the rigid blade mounting strut 76 terminates in a generally downward angled portion 82 which receives the extreme ends of the mixing rods 56. Linings 79 are formed of abrasion resistant plastic or rubber.

Figure 10:
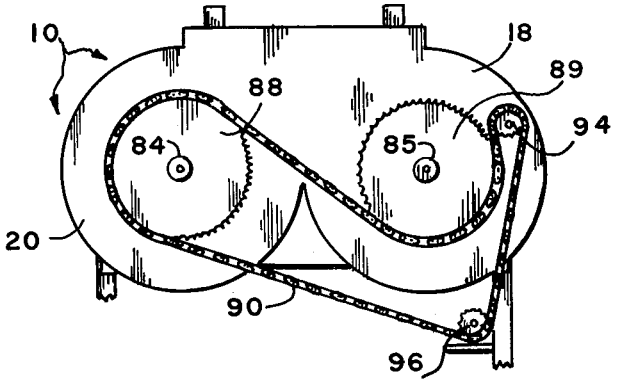
FIG. 10 is an end view of the mixor illustrating how the chain drive thereof is configured; and, FIG. 11 is a sectional, diagrammatic view of the water injection system.

As best viewed in FIG. 10, the impeller mounting shafts are keyed to suitable hubs 84, 85 which mount conventional drive gears 88, 89 which are driven in opposite directions by a conventional drive chain 90. Chain 90 trains on an idler pulley 94, and a drive pulley 96 driven by a suitable motor (not shown). In this manner rotation of the impeller assemblies 50 will be effectuated in opposite directions. For example, with reference now to FIG. 8, opposite rotation of the impeller assemblies will move material between each casing 18 or 20 through the common wall area 22 in the direction of the arrows generally indicated by the reference numeral 90. At this time material will accumulate, forming an arch, generally designated by the reference numeral 92, interiorly of the mixing chamber. As this occurs, material will be forced by rotation of the opposite impeller assemblies towards the discharge opening generally designated by reference numeral 98. Thus materials, once blended, will tend to move toward the discharge opening, and the generally uniform mix will be dispatched therefrom.

Figure 11:
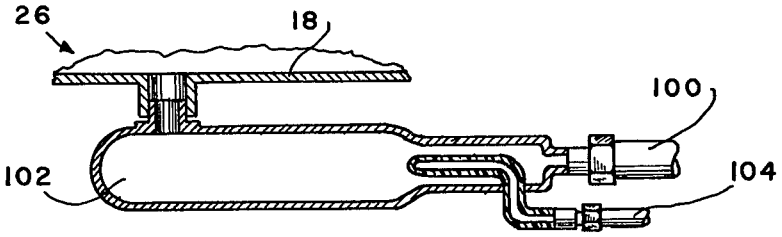

The water and air injection system generally designated by the reference numeral 26 is conventional. Air pressure is delivered through a line 100 interiorly of mixing manifold 102 (FIG. 11). Simultaneously hose 104 delivers a liquid detergent so that a mix is formed interiorly of manifold 102. This is sprayed through conventional nozzle assemblies internally of the casing 18 or 20 to lubricate the solids therewithin.

As the blend is conveyed toward the front 120 of the apparatus, it will be conveyed downwardly over an inclined plane 121 towards opening 98. Door assembly 140 may thus be manipulated to discharge the blend from the chamber. The door assembly 140 includes a door plate 142 which is pressed or moved away from opening 98 to discharge the materials. Plate 142 is mounted to a generally arcuate link 144 which is secured to the front of the chamber by a pivot assembly 146. Handle 148 is pivotally coupled to link 144 by another link 150, and, when the handle is moved between the positions illustrated in dashed lines, the door will thus be opened or closed. A latch 157 includes internal slots for securing handle 148 in either the door open or door closed position.

From the foregoing, it will be seen that this invention is one well adapted to obatian all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A mixing device for preparing wet mix cementitious products, the device comprising:

a rigid frame adapted to be disposed upon a solid supporting surface;

a pair of generally tubular, horizontally disposed pump casings elevated by said frame and sharing a common open side, the casings forming a mixing chamber, and each casing having front and rear ends and inner surfaces provided with an abrasion resistant liner;

an upper, open top through which raw material to be mixed may be inputted interiorly of said mixing chamber;

two elongated, central impeller shafts, one each extending longitudinally within each of said casings, and rotatably terminating in said front and rear ends of said casings;

an impeller assembly rotatably disposed longitudinally within each of said casings and removably coupled to an impeller shaft, each of said impeller assemblies including a terminal end and each comprising:

a pair of rigid, spaced-apart spiders, a spider being defined at each of said terminal ends, and each spider having three equally radially spaced-apart and integral arm segments extending outwardly from a central spider region provided with an inner notch adapted to be selectively manually removably coupled to said said impeller shaft, the notches of each spider being radially, angularly offset from each other to facilitate positive placement and maintenance of said impeller assemblies in generally coaxial relation relative to said shafts;

a plurality of pairs of spiralled, spaced-apart mixing rods extending generally longitudinally within the casing between opposite spaced-apart arm segments of the spiders, said rods being spaced apart from each other a distance substantially equal to or greater than the size of the largest constituent aggregate piece in the cementitious mixture to be blended; and, a spiralled outermost, resilient wiping blade extending between the outermost portions of said spider arm segments in spaced-apart relation with respect to said mixing rod pairs for wipingly contacting the casing liner in response to rotation of the impeller assembly;

hub means for removably securing said spiders to said impeller shafts to prevent relative rotation therebetween;

a material discharge opening defined in said mixing device between said casings at the front ends thereof;

means for rotating said impeller shafts whereby to rotate said impeller assemblies in opposite directions and thus effectuate the mixing of materials within said pump casings simultaneously with the forced conveyance of said materials toward said discharge opening; and, door means for selectively opening and closing said discharge opening to control output of said mixed material.

2. The mixing device as defined in claim 1 wherein said door means comprises:

a generally planar door plate adapted to sealably cover or uncover said discharge opening;

double ended arcuate link means pivotally coupled at one of its end to said door plate and pivotally secured at an opposite end to an end of said mixing device;

handle means coupled to said link means and manually displaceable between a door plate opening position and a door plate closing position, manual movement of said handle means between said latter two positions causing said door plate to move within an arc occupying a first hypothetical plane which perpendicularly bisects a second hypothetical plane occupied by the shafts within said casings, the plane of said door plate being substantially parallel with the plane of said discharge opening when said door occupies a closed position; and, means for temporarily locking said handle means in a desired one of said door plate positions.

* * * * *